US006511245B1

(12) United States Patent
Tan

(10) Patent No.: US 6,511,245 B1
(45) Date of Patent: Jan. 28, 2003

(54) PHOTOGRAPH ALBUM PAGE AND SYSTEM

(76) Inventor: Whang Kwee Tan, 17 A. Ah Soo Garden, Singapore (SG), 539976

( * ) Notice: Subject to any disclaimer, the term of this patent is extended or adjusted under 35 U.S.C. 154(b) by 0 days.

(21) Appl. No.: 09/556,107

(22) Filed: Apr. 21, 2000

Related U.S. Application Data

(63) Continuation-in-part of application No. 09/497,837, filed on Feb. 3, 2000, which is a continuation-in-part of application No. 09/394,466, filed on Sep. 11, 1999, now Pat. No. 6,109,657, which is a continuation-in-part of application No. 09/369,708, filed on Aug. 6, 1999, now Pat. No. 6,142,696, which is a continuation-in-part of application No. 09/350,612, filed on Jul. 9, 1999, now Pat. No. 6,056,494, which is a continuation-in-part of application No. 09/234,222, filed on Jan. 20, 1999, now Pat. No. 5,997,041.

(51) Int. Cl.[7] ..... B42F 13/00

(52) U.S. Cl. ..... 402/79; 281/22; 281/38; 206/455; 40/775; 40/654.01

(58) Field of Search ..... 402/4, 70, 73, 402/79, 80 R, 80 L, 80 P; 281/21.1, 15.1, 38, 31, 51; 206/455; 40/720, 722, 775, 776, 777, 654.01

(56) References Cited

U.S. PATENT DOCUMENTS 3,651,591 A * 3/1972 Woodyard ..... 40/104.19
5,393,158 A * 2/1995 Dall'Arancio ..... 402/79
6,135,663 A * 10/2000 Tan ..... 281/38

* cited by examiner

*Primary Examiner*—Willmon Fridie, Jr.

(57) ABSTRACT

A photograph album page and system is adapted to be coupled with similar pages for displaying a plurality of photographs of a wide variety of sizes in a convenient manner. A rectangular backing sheet has an upper and a lower edge and also an interior edge and an exterior edge with an upper and a lower surface. A plurality of primary holes are formed through the sheet thus forming photograph receiving areas. A rectangular transparent bag is formed of an upper layer overlying the upper surface of the sheet and a lower layer overlying the lower surface of the sheet with closed upper, lower, and exterior edges and an open interior edge for receiving the sheet and for the passage of photographs. Heat sealed couplings are provided between the bag and the primary holes. A hinge plate of a relatively stiff material, is formed in a rectangular configuration with an inner surface and an outer surface and with upper and lower and interior edges adjacent to the upper and lower and interior edges of the sheet and with an exterior edge. A first strip of double faced adhesive is provided for coupling the inner surface of each hinge plate to the page. A second strip of double faced adhesive is provided for coupling the outer surface of the hinge plate to an adjacent hinge plate.

8 Claims, 8 Drawing Sheets

PHOTOGRAPH ALBUM PAGE AND SYSTEM

RELATED APPLICATIONS

This application is a continuation-in-part of allowed application Ser. No. 09/394,466 filed Sep. 11, 1999 now U.S. Pat. No. 6,109,657, issued Ser. No. 09/234,222 filed Jan. 20, 1999 now U.S. Pat. No. 5,997,041, allowed Ser. No. 09/350,612 filed Jul. 9, 1999 now U.S. Pat. No. 6,056,494, Ser. No. 09/369,708 filed Aug. 6, 1999 now U.S. Pat. No. 6,142,696, and application Ser. No. 09/497,837 filed Feb. 3, 2000.

BACKGROUND OF THE INVENTION

1. Field of the Invention

The present invention relates to a photograph album page and system and more particularly pertains to displaying a plurality of photographs of a wide variety of sizes in a convenient manner.

2. Description of the Prior Art

The use of photograph album pages of known designs and configurations is known in the prior art. More specifically, photograph album pages of known designs and configurations previously devised and utilized for the purpose of displaying photographs through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,702,026 to Shaine discloses a method of making pages of a photo album. U.S. Pat. No. 5,242,522 to Moir discloses a method for producing a photo album page.

While these devices fulfill their respective, particular objectives and requirements, the aforementioned patents do not describe a photograph album page and system that allows displaying a plurality of photographs of a wide variety of sizes in a convenient manner.

In this respect, the photograph album page and system according to the present invention substantially departs from the conventional concepts and designs of the prior art, and in doing so provides an apparatus primarily developed for the purpose of displaying a plurality of photographs of a wide variety of sizes in a convenient manner.

Therefore, it can be appreciated that there exists a continuing need for a new and improved photograph album page and system which can be used for displaying a plurality of photographs of a wide variety of sizes in a convenient manner. In this regard, the present invention substantially fulfills this need.

SUMMARY OF THE INVENTION

In view of the foregoing disadvantages inherent in the known types of photograph album pages of known designs and configurations now present in the prior art, the present invention provides an improved photograph album page and system. As such, the general purpose of the present invention, which will be described subsequently in greater detail, is to provide a new and improved photograph album page and system and method which has all the advantages of the prior art and none of the disadvantages.

To attain this, the present invention essentially comprises pages for displaying a plurality of photographs of a wide variety of sizes in a convenient manner. A rectangular backing sheet is provided for each page. The backing sheet is fabricated of a flexible opaque material. The preferred material is paper. The sheet has an upper edge and a parallel lower edge at least 6 inches in width. The sheet also has an interior edge and a parallel exterior edge at least 12 inches in height. Each backing sheet has an upper surface and a lower surface. Each backing sheet also has a vertical centerline and a horizontal centerline forming an upper region between the horizontal centerline and the upper edge and a lower region between the horizontal centerline and the lower edge. A plurality of small primary holes are formed through each backing sheet. The small primary holes include a lower line of two horizontally aligned holes between the horizontal centerline and the lower edge. The small primary holes also include an upper line of two horizontally aligned holes between the horizontal centerline and the upper edge. The upper line and the lower line thus form an upper photograph receiving area between the upper edge and the upper line. An intermediate photograph receiving area is formed between the upper line and the lower line. A lower photograph receiving area is formed between the lower line and the lower edge. All three receiving areas are of an essentially common size. A plurality of small secondary holes are formed through each backing sheet. The small secondary holes include three vertically aligned holes spaced adjacent to the vertical centerline. The uppermost hole is formed within the intermediate receiving area closer to the lower line than to the upper line. The lowermost hole is formed within the lower receiving area closer to the lower edge than to the lower line. The intermediate hole is formed within the lower receiving area intermediate the uppermost and lowermost holes. A rectangular transparent bag is provided for each page. The bag is fabricated of a flexible plastic material. The preferred material for the bag is polypropylene. The bag functions to receive and display photographs. Each bag is formed of an upper layer overlying the upper surface of the sheet and a lower layer overlying the lower surface of the sheet. Each bag has a closed upper edge adjacent to the upper edge of the sheet. Each bag also has a closed lower edge adjacent to the lower edge of the sheet. Each bag also has a closed exterior edge adjacent to the exterior edge of the sheet. Finally, each bag has an open interior edge receiving the sheet and spaced from the interior edge of the sheet for the passage of photographs to be received and supported by the bag. Next provided are heat sealed couplings between each bag and the primary holes. The heat sealed couplings form a unitive page with three similarly sized pockets on both the upper and lower surfaces of the sheet. The secondary holes function as alignment guides for smaller photographs. A die cut slit is next provided. The die cut slit extends through each layer of the bag. The die cut slit is parallel with, and a short distance from, the upper edge of the bag. The die cut slit allows for the passage of panorama sized photographs there through. Next provided is a hinge plate for each sheet. The hinge plate is fabricated of a relatively stiff material. The preferred material for the hinge plate is cardboard. The hinge plate is formed in a rectangular configuration. The hinge plate has an inner surface and an outer surface. The hinge plate also has upper and lower and interior edges adjacent to the upper and lower and interior edges of the sheet. The hinge plate also has an exterior edge adjacent to the interior edge of the bag. Next provided is a first strip of double faced adhesive. The first strip of adhesive couples each inner surface of each hinge plate to a sheet in an uncovered region remote from the bag. Next provided is a second strip of double faced adhesive. This second strip of double faced adhesive is coupled to the outer surface of each hinge plate for coupling to a superposed adjacent sheet. Lastly, a peel strip is provided over the adhesive of each strip prior to use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved photograph album page and system which has all of the advantages of the prior art photograph album pages of known designs and configurations and none of the disadvantages.

It is another object of the present invention to provide a new and improved photograph album page and system which may be easily and efficiently manufactured and marketed.

It is further object of the present invention to provide a new and improved photograph album page and system which is of durable and reliable constructions.

An even further object of the present invention is to provide a new and improved photograph album page and system which is susceptible of a low cost of manufacture with regard to both materials and labor, and which accordingly is then susceptible of low prices of sale to the consuming public, thereby making such photograph album page and system economically available to the buying public.

Even still another object of the present invention is to provide a photograph album page and system for displaying a plurality of photographs of a wide variety of sizes in a convenient manner.

Lastly, it is an object of the present invention to provide a photograph album page and system which is adapted to be coupled with similar pages for displaying a plurality of photographs of a wide variety of sizes in a convenient manner. A rectangular backing sheet has an upper and a lower edge and also an interior edge and an exterior edge with an upper and a lower surface. A plurality of primary holes are formed through the sheet thus forming photograph receiving areas. A rectangular transparent bag is formed of an upper layer overlying the upper surface of the sheet and a lower layer overlying the lower surface of the sheet with closed upper, lower, and exterior edges and an open interior edge for receiving the sheet and for the passage of photographs. Heat sealed couplings are provided between the bag and the primary holes. A hinge plate of a relatively stiff material, is formed in a rectangular configuration with an inner surface and an outer surface and with upper and lower and interior edges adjacent to the upper and lower and interior edges of the sheet and with an exterior edge. A first strip of double faced adhesive is provided for coupling the inner surface of each hinge plate to the page. A second strip of double faced adhesive is provided for coupling the outer surface of the hinge plate to an adjacent hinge plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
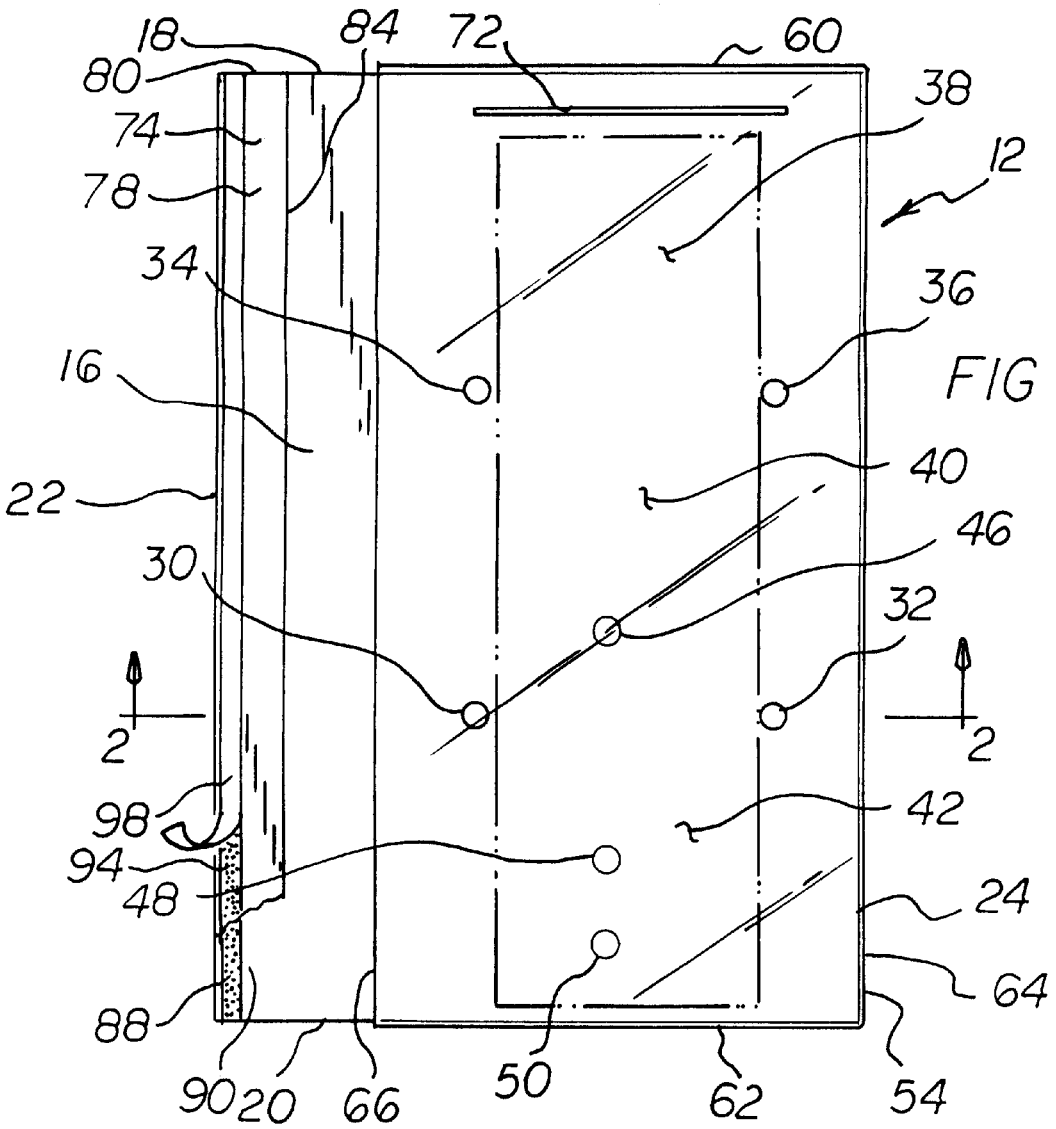
FIG. 1 is front elevational view of a photograph album page and system constructed in accordance with the primary embodiment of the present invention.
Figure 2:
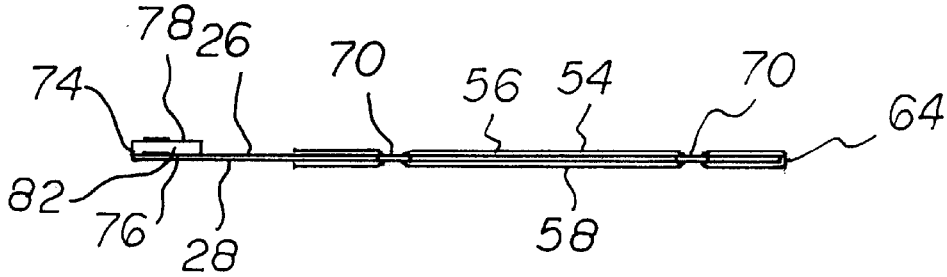
FIG. 2 is a cross sectional view taken along line 2—2 of FIG. 1.
Figure 3:
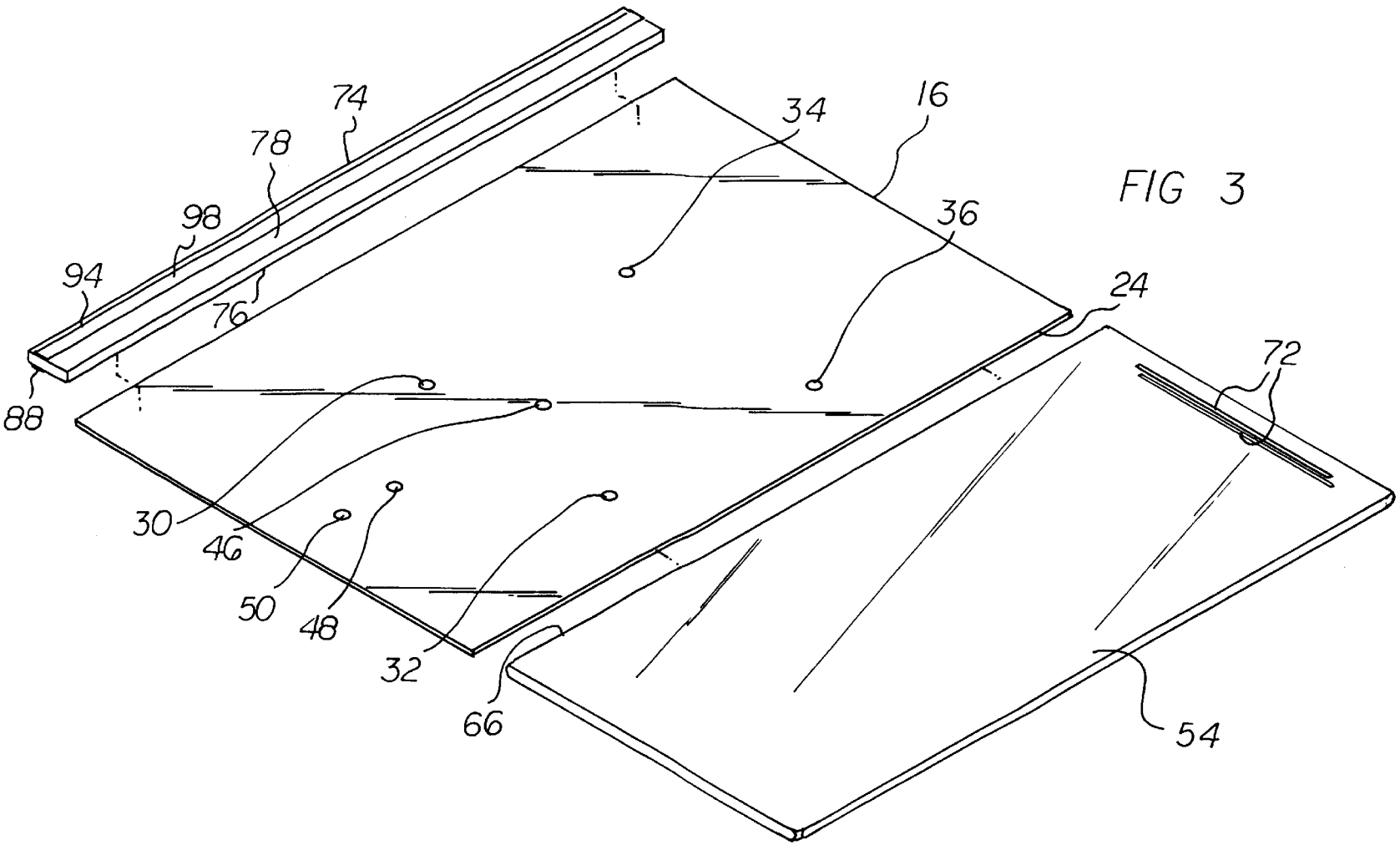
FIG. 3 is an exploded perspective view of the sheet shown in FIGS. 1 and 2.
Figure 4:
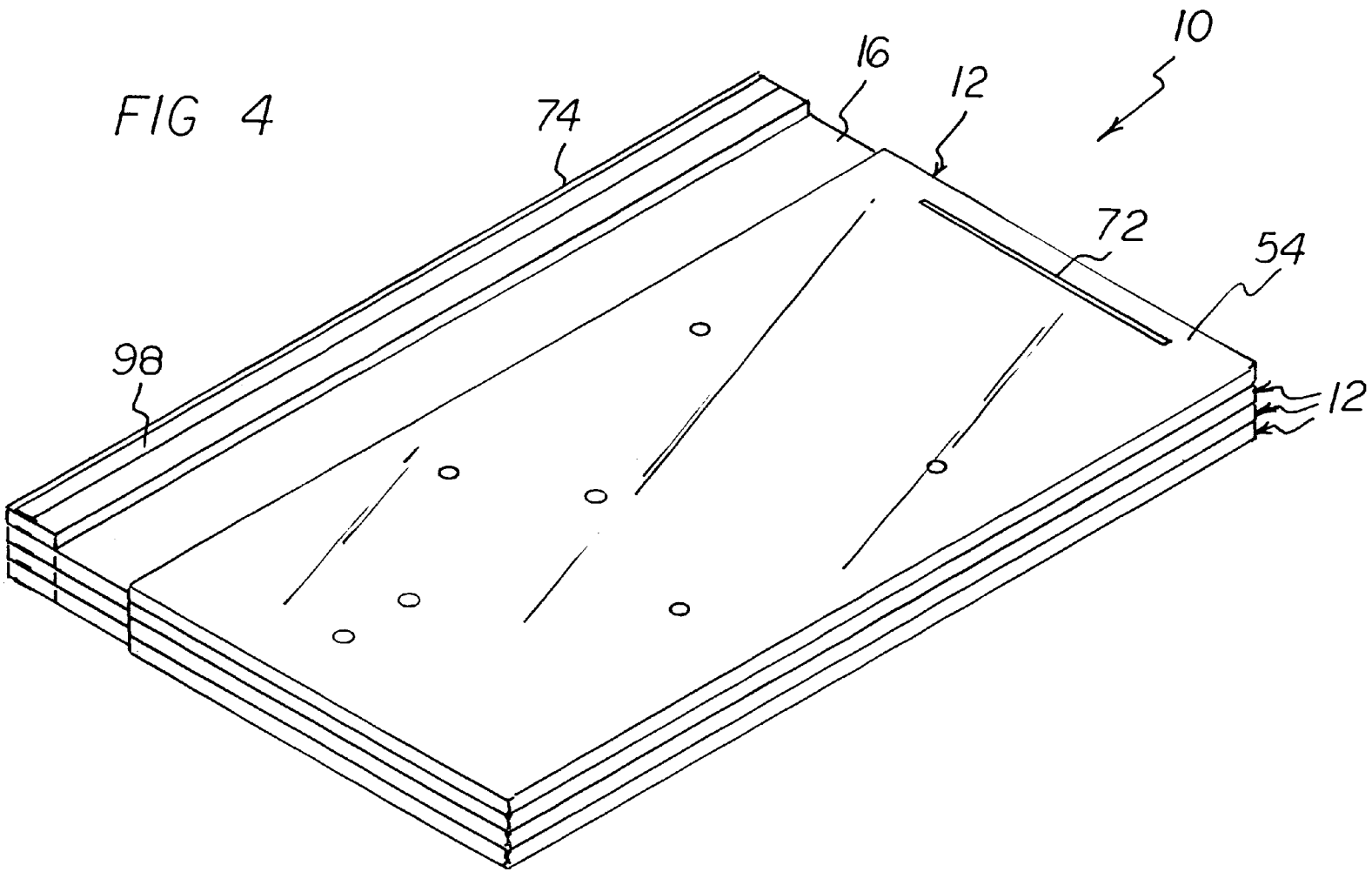
FIG. 4 is a perspective illustration of a plurality of pages coupled together to form an album.

With reference now to the drawings, and in particular to FIG. 1 thereof, the preferred embodiment of the new and improved photograph album page and system embodying the principles and concepts of the present invention and generally designated by the reference numeral 10 will be described.

The present invention, the photograph album page and system 10 is comprised of a plurality of components. Such components in their broadest context include a rectangular backing sheet, a plurality of primary holes, a rectangular transparent bag, heat sealed couplings between the bag and the primary holes, a hinge plate, and two strips of double faced adhesive. Such components are individually configured and correlated with respect to each other so as to attain the desired objective.

Pages 12 are provided for displaying a plurality of photographs of a wide variety of sizes in a convenient manner. A rectangular backing sheet 16 is provided for each page. The backing sheet is fabricated of a flexible opaque material. The preferred material is paper. The sheet has an upper edge 18 and a parallel lower edge 20 at least 6 inches in width. The sheet also has an interior edge 22 and a parallel exterior edge 24 at least 12 inches in height. Each backing sheet has an upper surface 26 and a lower surface 28. Each backing sheet also has a vertical centerline and a horizontal centerline forming an upper region between the horizontal centerline and the upper edge and a lower region between the horizontal centerline and the lower edge.

A plurality of small primary holes 30, 32, 34, 36 are formed through each backing sheet. The small primary holes include a lower line of two horizontally aligned holes 30, 32 between the horizontal centerline and the lower edge. The small primary holes also include an upper line of two horizontally aligned holes 34, 36 between the horizontal centerline and the upper edge. The upper line and the lower line thus form an upper photograph receiving area 38 between the upper edge and the upper line. An intermediate photograph receiving area 40 is formed between the upper line and the lower line. A lower photograph receiving area 42 is formed between the lower line and the lower edge. All three receiving areas are of an essentially common size.

A plurality of small secondary holes 46, 48, 50 are formed through each backing sheet. The small secondary holes include three vertically aligned holes spaced adjacent to the vertical centerline. The uppermost hole 46 is formed within the intermediate receiving area closer to the lower line than to the upper line. The lowermost hole 50 is formed within the lower receiving area closer to the lower edge than to the lower line. The intermediate hole 48 is formed within the lower receiving area intermediate the uppermost and lowermost holes.

A rectangular transparent bag 54 is provided for each page. The bag is fabricated of a flexible plastic material. The preferred material for the bag is polypropylene. The bag functions to receive and display photographs. Each bag is formed of an upper layer 56 overlying the upper surface of the sheet and a lower layer 58 overlying the lower surface of the sheet. Each bag has a closed upper edge 60 adjacent to the upper edge of the sheet. Each bag also has a closed lower edge 62 adjacent to the lower edge of the sheet. Each bag also has a closed exterior edge 64 adjacent to the exterior edge of the sheet. Finally, each bag has an open interior edge 66 receiving the sheet and spaced from the interior edge of the sheet for the passage of photographs to be received and supported by the bag.

Next provided are heat sealed couplings 70 between each bag and the primary holes. The heat sealed couplings form a unitive page with three similarly sized pockets on both the upper and lower surfaces of the sheet. The secondary holes function as alignment guides for smaller photographs.

A die cut slit 72 is next provided. The die cut slit extends through each layer of the bag. The die cut slit is parallel with, and a short distance from, the upper edge of the bag. The die cut slit allows for the passage of panorama sized photographs there through.

Next provided is a hinge plate 74 for each sheet. The hinge plate is fabricated of a relatively stiff material. The preferred material for the hinge plate is cardboard. The hinge plate is formed in a rectangular configuration. The hinge plate has an inner surface 76 and an outer surface 78. The hinge plate also has upper and lower and interior edges 80, 82, 84 adjacent to the upper and lower and interior edges of the sheet. The hinge plate also has an exterior edge adjacent to the interior edge of the bag.

Next provided is a first strip 88 of double faced adhesive. The first strip of adhesive couples each inner surface of each hinge plate to a sheet in an uncovered region 90 remote from the bag.

Next provided is a second strip 94 of double faced adhesive. This second strip of double faced adhesive is coupled to the outer surface of each hinge plate for coupling to a superposed adjacent sheet.

Lastly, a peel strip 98 is provided over the adhesives of each strip prior to use.

Figure 5:
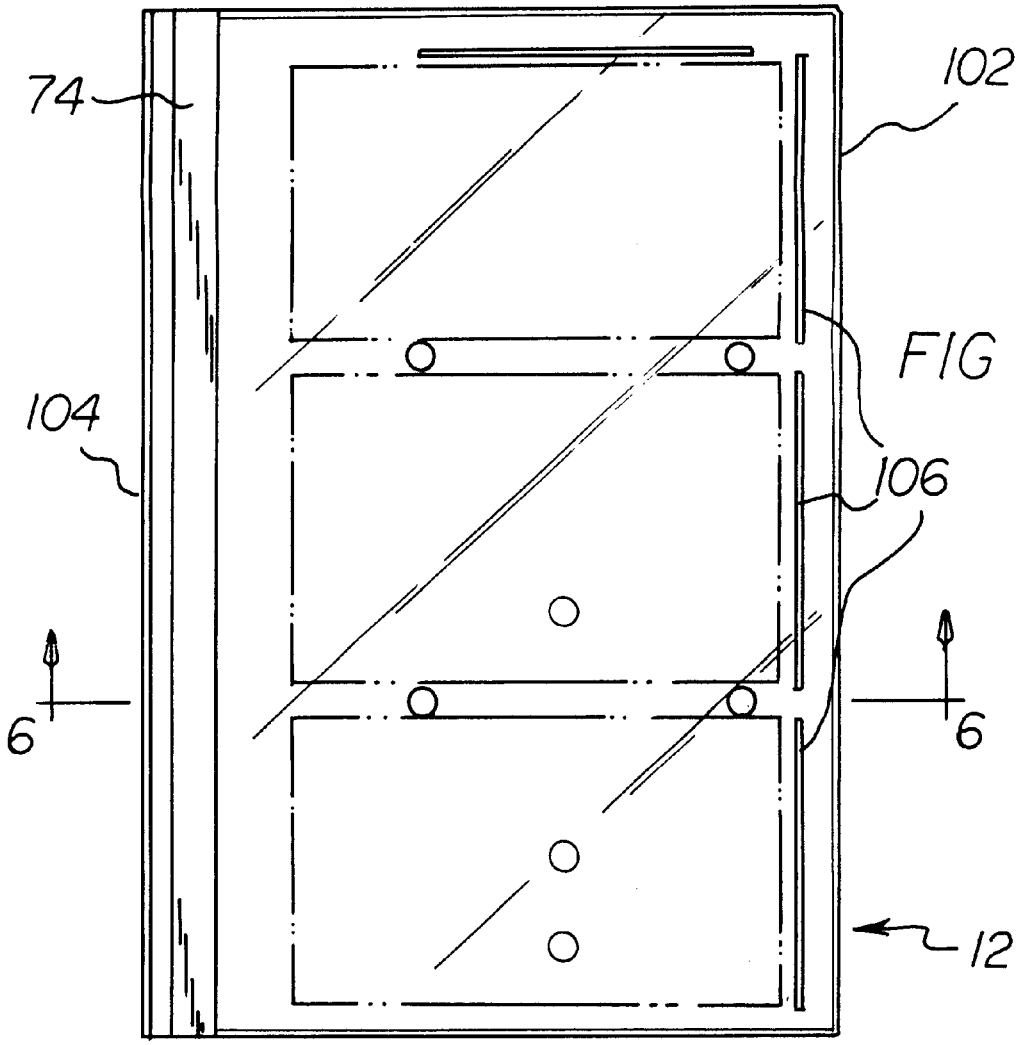
FIG. 5 is a front elevational view of an album page constructed in accordance with an alternate embodiment of the invention.
Figure 6:
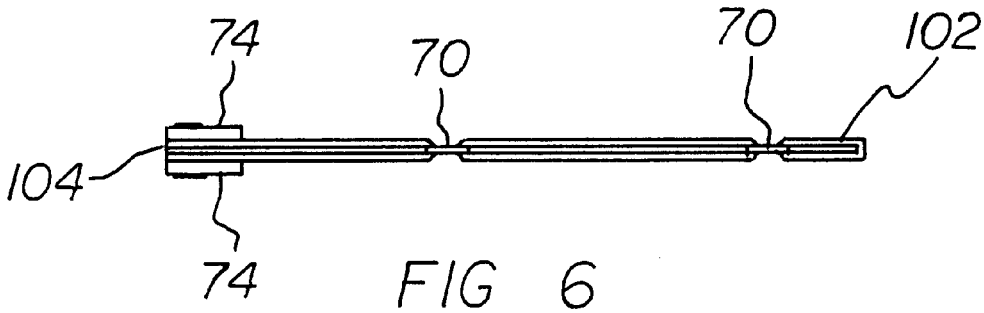
FIG. 6 is a cross sectional view of taken along line 6—6 of FIG. 5.
Figure 7:
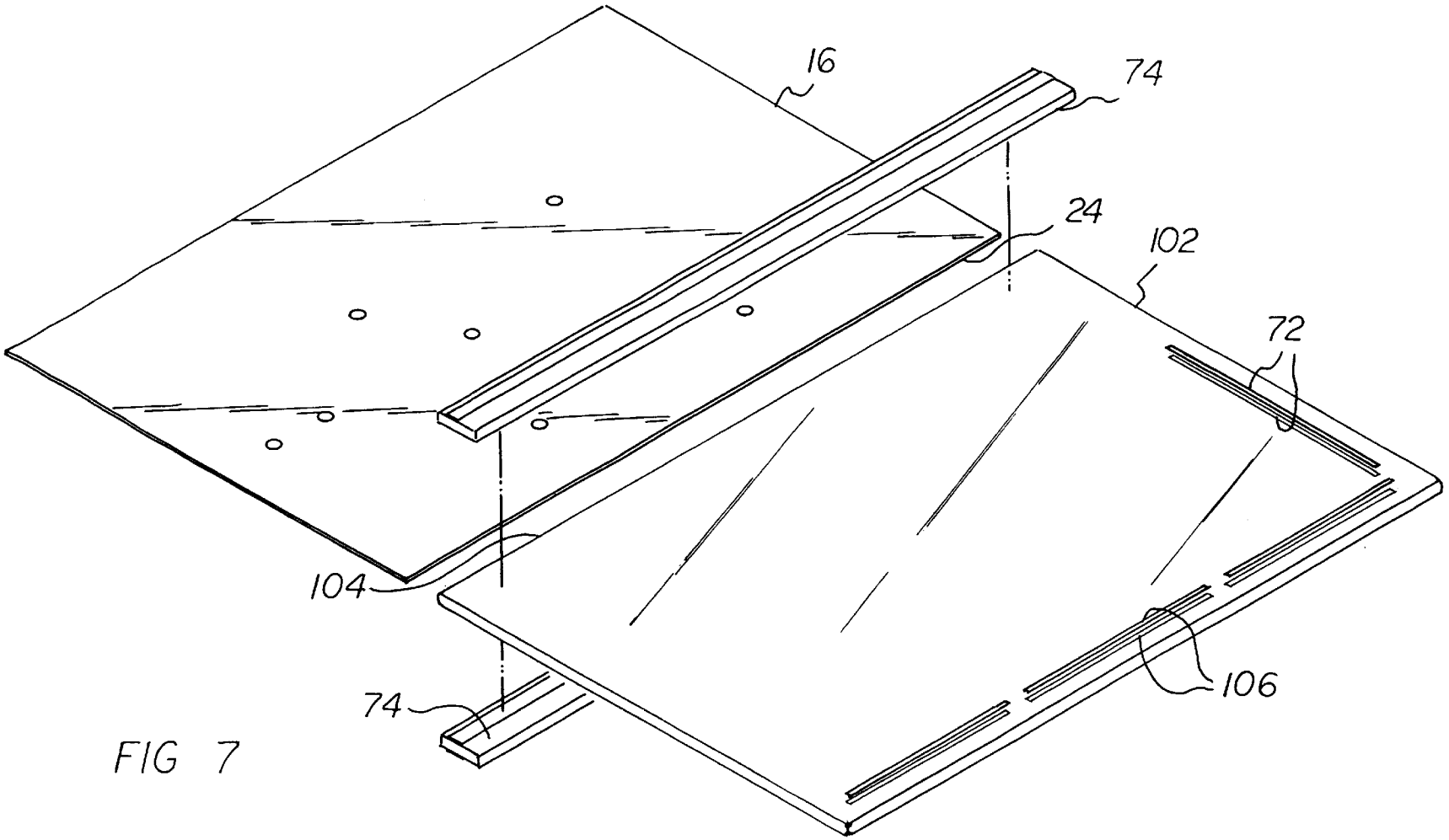
FIG. 7 is an exploded perspective view of the page shown in FIGS. 5 and 6.
Figure 8:
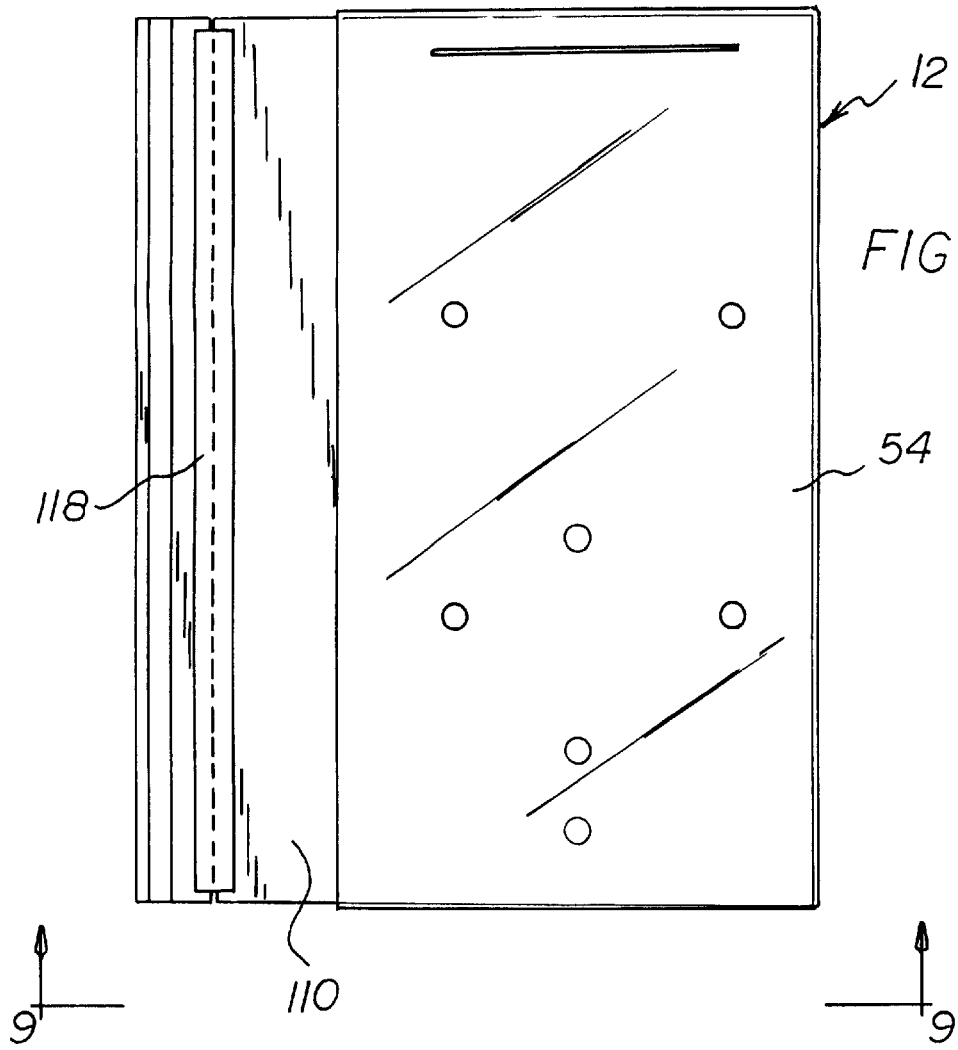
FIG. 8 is a front elevational view of an album page constructed in accordance with another alternate embodiment of the invention.
Figure 9:
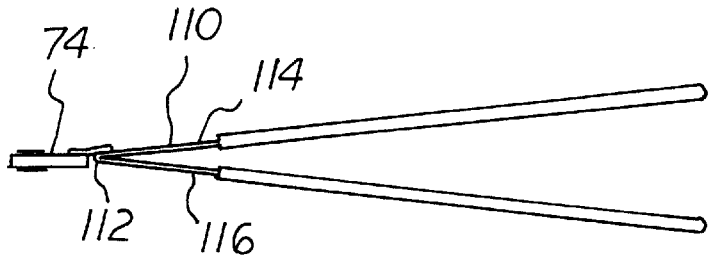
FIG. 9 is an end view taken along line 9—9 of FIG. 8.
Figure 10:
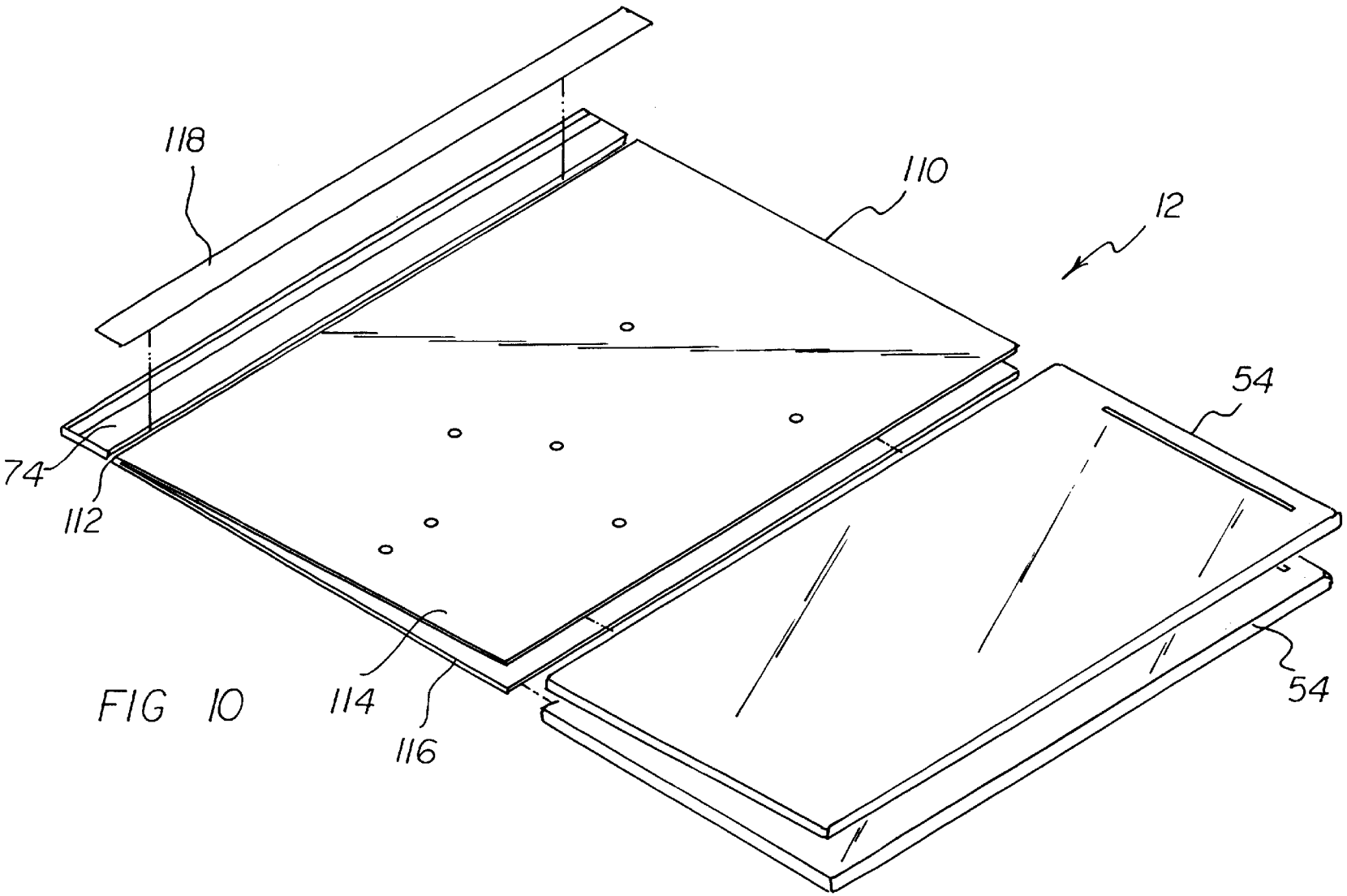
FIG. 10 is an exploded perspective view of the page shown in FIGS. 8 and 9.
Figure 11:
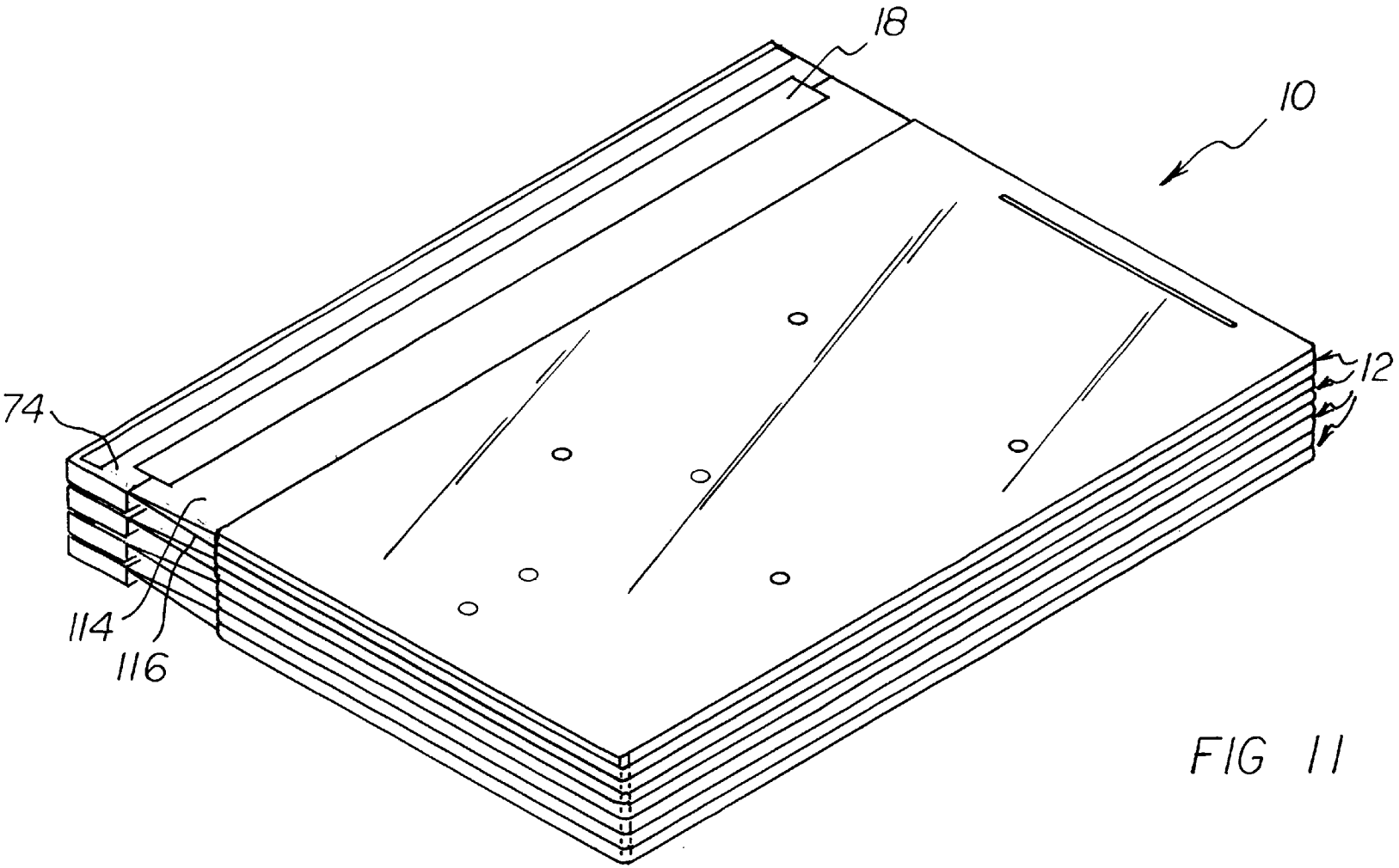
FIG. 11 is a perspective illustration of a plurality of pages shown in FIGS. 8, 9 and 10, but assembled in the form of an album.

An alternate embodiment of the invention is shown in FIGS. 5, 6 and 7. In this embodiment, the basic components are essentially the same as in the primary embodiment. The only difference is the use of an enlarged bag 102. Such enlarged bag is of such a size that its four edges essentially overlie the four edges of the backing sheet located within the bag. As such, the interior edge of the bag 104 extends over the interior edge of the backing sheet. In this embodiment, the hinge plate is positioned over the bag adjacent to the interior edge of the bag and coupled thereto through a double faced adhesive. In this embodiment, there is no pocket at the interior edge of the bag. As a result, there are provided a plurality, three in the preferred embodiment, of linear aligned die cut slits 106. Such slits extend through both layers of the bag. They are located closely spaced from the exterior edge of the bag and adjacent thereto. The spacing is preferably at least one millimeter from the edge to insure that photographs within the bag do not inadvertently fall out during handling of the page or album constructed of a plurality of such pages.

The final embodiment of the invention is shown in FIGS. 8 through 11. In this embodiment, the sheet is formed of a single enlarged sheet 110. Such sheet is folded vertically through the center thereof to form a fold line 112. The fold line separates the enlarged sheet into two separate sheets 114, 116. A bag is positioned over the free exterior ends of the two separate sheets. Thereafter, an adhesive tape 118 is used to couple the interior edge of the enlarged sheet at the fold line to the hinge plate. Thereafter, the hinge plates may be coupled together as in the prior embodiments through a double faced adhesive. It should be understood, however, that a single enlarged sheet folded to form a fold line with two separate sheets when coupled to a hinge plate by adhesive tape may be considered a photograph album by itself, with our without coupling to additional corresponding components. This arrangement of utilizing the adhesive tape as a hinge allows for folding of backing sheets fabricated of stiffer, less flexible material than in the prior embodiments.

The present invention is in a photograph album and in its pages. Each page is able to store normal size photographs (3 inches by 5 inches and 4 inches by 6 inches) and panoramic sizes (4 inches by 7 inches, 4 inches by 10 inches, 4 inches by 11 inches and 4 inches by 12 inches) photographs. Each page is comprised of a plastic bag and a sheet of paper with designated heat sealing points and, preferably, one or more die cut openings both to keep the plastic bag and sheet in position as well as to create compartments to store photographs.

The sheet of paper is at least 12 inches in height and at least 6 inches in width. It is drilled with sets of holes in designated positions. The first set of holes is comprised of two primary holes drilled horizontally which should be at least 4 inches from the top edge and at least 4 inches from the top edge and at least 4 inches apart from each other. The distance between the two holes should be able to allow panorama sized photographs to enter.

The second set of primary holes is comprised of two holes drilled horizontally which should be at least 4 inches from the bottom edge and at least 4 inches apart from each other and align with the two holes on top so that panoramic size photographs may be accommodated.

The set of secondary holes is comprised of three holes drilled vertically near the center of the paper. The lowermost hole is located about 1 inch from the bottom edge. The intermediate hole is located about 2 inches from the bottom edge. The uppermost hole is located about 5 inches from the bottom edge. These holes function as a guide line for storing panoramic photographs vertically.

A double sided adhesive tape may be adhered to the holes to preclude the panoramic photographs stored vertically dropping all the way to the bottom of the page and becoming difficult to take out.

A clear transparent plastic bag, preferably of polypropylene material, with a height of at least 12 inches and a width of at least 6 inches is used. The transparent plastic bag is die-cut with a horizontal opening at least 1 millimeter from the top edge horizontally. The slit is at least 4 inches long but less than 6 inches measuring from left to right. The opening is die-cut at least 1 millimeter from the top edge to create a cap to preclude the photographs sliding out. If the die-cut opening were done right at the top edge, then photographs would slide out easily when overturned.

The sheet will then be inserted into the transparent plastic bag. The entire page is comprised of the plastic bag and the sheet and will be heat-sealed under appropriate heat together with the bonding of melted plastic through the designated drilled primary holes. It is important to point out that the set of secondary holes, which are drilled vertically, will not be heat-sealed together.

The height of the clear transparent plastic bag should be equal to or greater than the length of the sheet. The width of the sheet in the primary embodiment should be greater than the width of the clear transparent plastic bag. The sheet is inserted into the transparent bag from the left all the way to the end of the transparent bag and leaving the extra uncovered portion of the sheet to be the space for recording memo purposes.

The photographs are held in position with the help of two sets of heat-sealed spots. The photographs may be inserted horizontally or vertically.

The third component of the page is the adding of a hinge plate to the sheet. There are two types of hinges, depending on the thickness of the page. For pages that are soft and thin, at least one hinge plate will be placed on the sheet on the side nearest to the spine. The hinge plate is made of a long and narrow strip of thicker paper, preferably cardboard, having the same length as the sheet. The number of hinges used will be depending on how thick the photographs are, as the main purpose of the hinge is to allow the photo album to stay flat and even when filled with photographs. There will be double-side tape adhered on the hinge plate. The purpose of the double-sided tape is to bond the pages together one by one to form the photo album system.

For pages that are thick, another type of hinge plate will be applied because the above described method does not provide a sufficiently acceptable hinge arrangement that will allow the photo album to stay flexible and flat when open because the pages are harder when it is made from thick paper.

The construction of the page of this alternate embodiment will be a little different from the one described above. An enlarged sheet of paper at least 12 inches in height and at least 12 inches in width is used. The enlarged sheet is folded symmetrically to create two equally sized halves. The two halves will then be drilled with sets of holes that are exactly like the ones mentioned above. When the sheet is folded into two equal halves, two sheets are effectively created and, therefore, two transparent plastic bags are needed to make it into two album pages. After the transparent plastic bags and the paper are bonded together by heat-sealing in the appropriate spots, the hinge plate will be added. Due to the fact that the paper is thick, it will be difficult for the pages to stay flat when the album is opened. Therefore, this hinge is created to give some flexibility to the page.

The hinge plate is made from a thinner piece of paper with the same length as the page. It will be joined with a tape or glue. The reason to join the page and the hinge plate with tape or glue is that it will provide a flexible connection. Double-sided tape will be adhered on the hinge plate. The major function for the double-sided tape is to adhere all the pages together by stacking one by one. With the adhesive double-sided tape, the pages do not need to be held together by other forms of bonding such as glue or ties.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A photograph album constructed of pages for displaying a plurality of photographs of a wide variety of sizes in a convenient manner comprising, in combination:

a rectangular backing sheet for each page fabricated of a flexible opaque material, preferably paper, and having an upper edge and a parallel lower edge at least 6 inches in width and having an interior edge and a parallel exterior edge at least 12 inches in height, each backing sheet having an upper surface and a lower surface with a vertical centerline and a horizontal centerline forming an upper region between the horizontal centerline and the upper edge and a lower region between the horizontal centerline and the lower edge;

a plurality of small primary holes formed through each backing sheet including a lower line of two horizontally aligned holes between the horizontal centerline and the lower edge and an upper line of two horizontally aligned holes between the horizontal centerline and the upper edge, the upper line and the lower line thus forming an upper photograph receiving area between the upper edge and the upper line and also forming an intermediate photograph receiving area between the upper line and the lower line and also forming a lower photograph receiving area between the lower line and the lower edge with all three receiving areas being of an essentially common size;

a plurality of small secondary holes formed through each backing sheet including three vertically aligned holes spaced adjacent to the vertical centerline with the uppermost hole within the intermediate receiving area closer to the lower line than to the upper line and with the lowermost hole within the lower receiving area closer to the lower edge than to the lower line and with the intermediate hole within the lower receiving area intermediate the uppermost and lowermost holes;

a rectangular transparent bag for each page fabricated of a flexible plastic material, preferably polypropylene, for receiving and displaying photographs, each bag being formed of an upper layer overlying the upper surface of the sheet and a lower layer overlying the lower surface of the sheet with a closed upper edge adjacent to the upper edge of the sheet, a closed lower edge adjacent to the lower edge of the sheet, a closed exterior edge adjacent to the exterior edge of the sheet and an open interior edge receiving the sheet and spaced from the interior edge of the sheet for the passage of photographs to be received and supported by the bag;

heat sealed couplings between each bag and the primary holes to form a unitive page with three similarly sized pockets on both the upper and lower surfaces of the sheet with the secondary holes functioning as alignment guides for smaller photographs;

a die cut slit extending through each layer of the bag parallel with, and a short distance from, the upper edge of the bag for the passage of panorama sized photographs;

a hinge plate for each sheet fabricated of a relatively stiff material, preferably cardboard, formed in a rectangular configuration with an inner surface and an outer surface and with upper and lower and interior edges adjacent to the upper and lower and interior edges of the sheet and with an exterior edge adjacent to the interior edge of the bag; and a first strip of double faced adhesive coupling each inner surface of each hinge plate to a sheet in an uncovered region remote from the bag;

a second strip of double faced adhesive coupled to the outer surface of each hinge plate for coupling to a superposed adjacent sheet; and a peel strip covering the adhesive of each strip prior to use.

2. A photograph album page and system adapted to be coupled with similar pages for displaying a plurality of photographs of a wide variety of sizes in a convenient manner comprising:

a rectangular backing sheet having an upper and a lower edge and having an interior and an exterior edge with an upper and a lower surface;

a plurality of primary holes formed through the sheet thus forming photograph receiving areas;

a rectangular transparent bag formed of an upper layer overlying the upper surface of the sheet and a lower layer overlying the lower surface of the sheet with closed upper, lower, and exterior edges and an open interior edge for receiving the sheet and for the passage of photographs;

heat sealed couplings between the bag and the primary holes;

a hinge plate of a relatively stiff material, formed in a rectangular configuration with an inner surface and an outer surface and with upper and lower and interior edges adjacent to the upper and lower and interior edges of the sheet and with an exterior edge;

a first strip of double faced adhesive for coupling the inner surface of each hinge plate to the page; and a second strip of double faced adhesive for coupling the outer surface of the hinge plate to an adjacent hinge plate.

3. The page as set forth in claim 2 wherein the interior edge of the bag is spaced from the interior edge of the sheet to provide an uncovered area for receiving the hinge plate.

4. The page as set forth in claim 3 and further including a die cut slit through both layers of the bag adjacent to the upper edge thereof.

5. The page as set forth in claim 2 wherein the interior edge of the bag extends to the interior edge of the sheet with the hinge plate being positioned over the bag adjacent to the interior edge of the bag.

6. The page as set forth in claim 5 and further including a plurality of linearly aligned die cut slits extending through both layers of the bag and located closely spaced from, and adjacent to, the exterior edge of the bag.

7. The page as set forth in claim 6 wherein the sheet is formed from an enlarged sheet folded vertically through the center thereof to form a fold line with two separate sheets and with a bag positioned over the free exterior ends of the separate sheets.

8. The page as set forth in claim 6 and further including an adhesive tape coupling the sheet adjacent to its fold line to the hinge plate.

* * * * *